United States Patent [19]

Ammann

[11] 4,280,975

[45] Jul. 28, 1981

[54] METHOD FOR CONSTRUCTING A TURBINE SHROUD

[75] Inventor: Charles L. Ammann, Bloomfield, N.J.

[73] Assignee: General Electric Company, Cincinnati, Ohio

[21] Appl. No.: 84,243

[22] Filed: Oct. 12, 1979

[51] Int. Cl.[3] ..... F01D 25/24; B32B 3/00

[52] U.S. Cl. ..... 264/81; 29/156.4 WL; 415/200; 428/593; 428/598

[58] Field of Search ..... 415/200, 174; 428/593, 428/598; 264/60, 62, 81, 345; 29/156.4 WL

[56] References Cited

U.S. PATENT DOCUMENTS

| | | | |
|---|---|---|---|
| 3,053,694 | 9/1962 | Daunt et al. | 415/174 X |
| 3,126,149 | 3/1964 | Bowers, Jr. et al. | 415/174 |
| 3,339,933 | 9/1967 | Foster | 277/53 |
| 3,519,202 | 7/1970 | Davis | 277/230 |
| 3,843,278 | 10/1974 | Torell | 415/174 |
| 3,975,165 | 8/1976 | Elbert el al. | 428/550 |
| 4,087,199 | 5/1978 | Hemsworth et al. | 415/174 |

OTHER PUBLICATIONS

Shiembob, L. T., *Development of A Plasma Sprayed Ceramic Gas Path Seal for High Pressure Turbine Applications,* NTIS N77-25534, Apr. 1977.

*Primary Examiner*—Leonard E. Smith

*Attorney, Agent, or Firm*—Carl L. Silverman; Derek P. Lawrence

[57] ABSTRACT

A method for constructing a turbine shroud structure includes providing a metal substrate with a plurality of pegs extending therefrom. A ceramic sealing layer of zirconium oxide with about 20 weight percentage magnesium is applied to the peg-metal substrate structure. Intermediate bonding layers may be applied between the ceramic sealing layer and the peg-metal substrate structure. The ceramic sealing layer is then heat treated to a temperature of 1100° C. to increase the rub wear of the ceramic sealing layer and to reduce the thermal stress therein.

9 Claims, 3 Drawing Figures

METHOD FOR CONSTRUCTING A TURBINE SHROUD

BACKGROUND OF THE INVENTION

The present invention relates to turbine shrouds, and more particularly, to a method of making a metal-ceramic turbine shroud.

A composite metal-ceramic turbine shroud has been proposed in copending application of Sterman, et al., entitled "Metal-Ceramic Turbine Shroud and Method of Making the Same," Ser. No. 84,244, filed concurrently herewith. Basically, this composite metal-ceramic turbine shroud employs a ceramic sealing layer which is secured to a metal substrate through mechanical matrix bonding means, e.g., a plurality of pegs, yielding a ceramic sealing layer with desirable thermal stress characteristics.

Although such composite metal-ceramic shroud structure is satisfactory for many applications, it is also desirable to provide such a composite metal-ceramic shroud structure with desirable rub wear characteristics. More particularly, it is desirable that the ceramic sealing layer in such a shroud structure wear more easily than the more costly turbine blade tips.

It is, therefore, an object of the present invention to provide a method of constructing an improved turbine shroud structure.

Another object of the present invention is to provide such a method in which the turbine shroud structure has a ceramic sealing layer which exhibits desirable rub wear characteristics and desirable thermal stress characteristics.

It is another object of the present invention to provide such a method in which the ceramic sealing layer comprises zirconium oxide modified with magnesium oxide.

SUMMARY OF THE INVENTION

In one form of my invention, I provide a method of constructing a turbine shroud structure. The method includes the steps of providing a metal substrate and providing the metal substrate with mechanical matrix bonding means. A ceramic sealing layer of zirconium oxide with magnesium oxide is applied to the mechanical matrix bonding means. The ceramic sealing layer is then heat treated to increase its rub wear and to develop an ordered pattern of very fine cracks therein which reduce the thermal stress in the ceramic sealing layer.

BRIEF DESCRIPTION OF THE DRAWINGS

While the specification concludes with claims particularly pointing out and distinctly claiming that which is regarded as the present invention, the objects and advantages of this invention can be more readily ascertained from the following description of preferred embodiments when read in conjunction with the accompanying drawings in which:

DESCRIPTION OF THE PREFERRED EMBODIMENT

Figure 1:
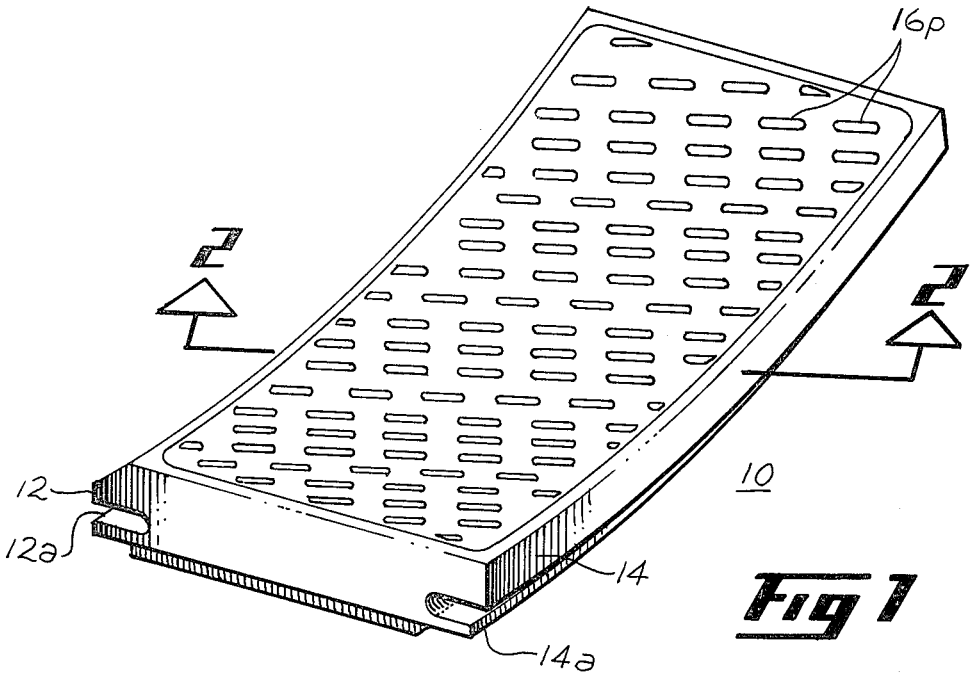
FIG. 1 is an isometric view showing one form of turbine shroud structure constructed in accordance with the present invention.
Figure 2:
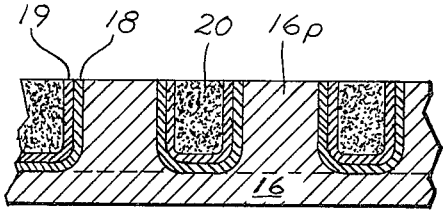
FIG. 2 is a sectional side view taken along line 2—2 of FIG. 1.

Referring initially to FIG. 1, a turbine shroud structure constructed in accordance with one form of the method of the present invention is generally designated 10. The turbine shroud structure 10 includes a pair of opposing flanges 12, 14 which define grooves 12*a*, 14*a* which are suitable for use in attaching the turbine shroud 10 to a turbine shroud support assembly. The turbine shroud 10 includes a metal substrate 16 with mechanical matrix bonding means which may be in the form of a plurality of pegs 16*p* extending away from the metal substrate 16 and toward the blade-receiving surface of the shroud. As shown in FIG. 2, such pegs 16*p* may comprise an extension of the metal substrate 16. Exemplary materials for the metal substrate 16 and pegs 16*p* include nickel base Rene' 77, cobalt base M-509 or X-40.

An intermediate bonding layer 18 is disposed on the metal substrate 16 and partially fills the spaces created by the pegs 16*p*. Typical thicknesses of the bonding layer 18 are from about 0.005 to 0.010 inches. An exemplary intermediate bonding layer 18 may comprise a nickel chrome alloy commonly known as NiCrAlY, e.g., 95–100% NiCrAlY. This intermediate bonding layer 18 may be applied through the technique of plasma spraying.

A second intermediate bonding layer 19 may be disposed, e.g., plasma sprayed, on top of the first intermediate bonding layer 18. Typical thicknesses of the bonding layer 19 are from about 0.004 to 0.006 inches. The second intermediate layer 19 may, for example, comprise a blend of the materials in the first intermediate layer 18 with a ceramic material. A ceramic sealing layer 20, such as zirconium oxide modified with magnesium oxide, is disposed, e.g., plasma sprayed or sintered, on top of second intermediate bonding layer 19. With such a ceramic sealing layer 20, second intermediate bonding layer 19 may comprise a blend composition of about: 50% NiCrAlY/50% zirconium oxide modified with magnesium oxide. The relative dimensions of the pegs 16*p*, intermediate bonding layers 18, 19, and ceramic sealing layer 20 are selected such that the pegs 16*p* extend at least partially through the ceramic sealing layer 20. One such configuration is shown in FIGS. 1 and 2 wherein the pegs 16*p* extend substantially through the ceramic sealing layer 20.

Generally, the present invention relates to a method of constructing a shroud, which may be similar to shroud 10 of FIGS. 1 and 2, wherein the ceramic sealing layer 20 is generally less than about 0.090 inches in thickness and comprises zirconium oxide modified with a material such as magnesium oxide wherein the resultant ceramic sealing layer 20 is abradable and therefore provides a satisfactory seal when employed in cooperation with a rotating turbine blade assembly (not shown).

More particularly, in one form of the method of the present invention, metastable cubic zirconium oxide, modified with magnesium oxide, is heat treated. It has been found that, with respect to ceramic sealing layer wear, such heat treatment transforms the metastable cubic form of zirconium oxide into favorable monoclinic and tetragonal forms of zirconium oxide. In this condition, it has been found that, after such heat treatment, the ceramic sealing layer evidences increased rub wear with respect to the cooperating turbine blades. This desirable rub wear characteristic of the heat treated ceramic sealing layer may be more definitively stated as a Blade Wear to Incursion Ratio (BWIR) where such Ratio represents: Blade Tip Wear divided by Total Depth of Incursion Between Shroud and Blade Tip. As is apparent, lower Ratios are more desirable than high Ratios, as lower Ratios indicate that the ceramic sealing layer is performing its function of abrading while minimizing blade tip wear. In this connection, it is to be appreciated that, it is less difficult, and less expensive, to replace or repair an abraded ceramic sealing layer as compared to the replacement or repair of the cooperating turbine blade. In addition, the heat treatment has been found to unexpectedly improve the particle erosion resistance of the ceramic sealing layer.

In addition to the desirable ceramic sealing layer rub wear characteristics obtained through the method of the present invention, desirable ceramic sealing layer thermal stress characteristics are also obtained. More particularly, the heat treatment functions to produce an ordered pattern of very fine stress-relieving cracks in the ceramic sealing layer. Indeed, it has been found that the number of such very fine stress-relieving cracks is increased as a result of the heat treatment.

Generally, in the method of the present invention, the zirconium oxide employed includes from about 6 to about 25 weight percentage magnesium oxide, with about 20 weight percentage being preferred. The heat treatment generally includes heating to a temperature of about 900° C.–1400° C. for a time period of about 2 to 30 hours, with lower temperatures in this range generally requiring longer periods of time. The ceramic sealing layer may be applied through various deposition techniques, such as plasma spraying or sintering, with plasma spraying being preferred. Typical conventional plasma spraying parameters may be employed, e.g.: 5 pound/hr rate; 500 amps; 64 to 70 D.C. volts.

It is to be appreciated that the desirable results obtained through the method of the present invention are quite unexpected. In this connection, zirconium oxide modified with yttrium oxide was heat treated and such heat treatment was found to actually increase the Blade Wear to Incursion Ratio. More particularly, zirconium oxide modified with 20 weight percentage yttrium oxide was heat treated. Before heat treatment, the Blade Wear to Incursion Ratio was 0.44 while after the heat treatment, the Blade Wear to Incursion Ratio deteriorated to a value of 0.56.

The method of the present invention may be employed in connection with shroud structures other than the one shown in FIGS. 1 and 2. More particularly, the method is suitable for use in connection with other mechanical matrix bonding means. For example, the method may also be employed in connection with mechanical matrix bonding means in the form of wire mesh, honeycomb, chain link, and combinations thereof. For a further discussion of shroud structures employing such mechanical matrix bonding means, see the previously mentioned copending application of Sterman, et al., which is hereby incorporated into reference in the present application.

The method of the present invention may be further appreciated by reference to the following Example: it being understood that the method of the present invention is not limited to the details recited therein.

EXAMPLE

Several turbine shroud structures, such as the one shown in FIG. 1, were constructed. The first intermediate bonding layer 18 comprised 95–100% density NiCrAlY. The second intermediate bonding layer 19 comprised a blend composition of about 50% NiCrAlY/50% zirconium oxide with magnesium oxide. The ceramic sealing layer composition comprised zirconium oxide modified with about 20 weight percentage magnesium oxide. The zirconium oxide was substantially 100% metastable cubic in form. About 0.060 inches of the ceramic sealing layer was applied on the pegs 16*p* through plasma spraying.

One of the resultant turbine shrouds was then tested by rubbing with simulated turbine blades. The testing included rubbing with Rene'80, a nickel base alloy composition, simulated turbine blades at a tip speed of 750 ft/sec for a time period of 20–30 seconds at 0.002 inch/sec incursion rate. After such testing, the Blade Wear to Incursion Ratio was determined to be 0.83.

Two turbine shrouds substantially identical to the one above tested were then heat treated. The heat treatment comprised heating the shroud to a temperature of about 2000° F. (1100° C.), for a time of about 30 hours. The heat treatment included: heating to 2000° F. for 5 hours in a vacuum of 1 micron or less; followed by cooling to room temperature. This cycle was repeated six times with the last 1 hour of the last heating cycle being taken to 2125° F. These heat treated shrouds were then tested as above. After such testing of the heat treated shrouds, the average Blade Wear to Incursion Ratio was determined to be 0.15, with the highest Ratio being 0.20.

Figure 3:
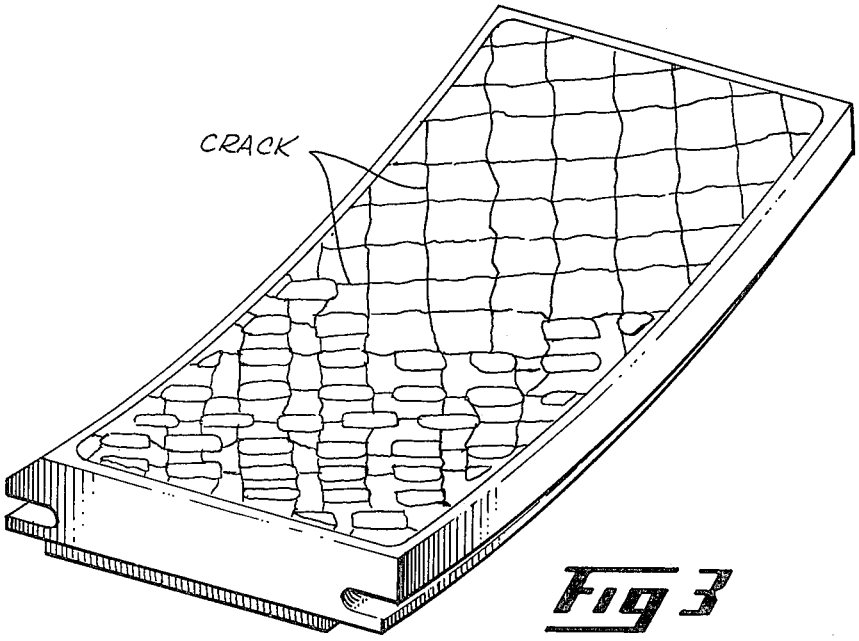
FIG. 3 is a representation of a photograph of a zirconium oxide ceramic sealing layer heat treated in accordance with one form of the method of the present invention.

It was noted that, as a result of such heat treating, the ceramic sealing layer developed an ordered pattern of more fine thermal stress relieving cracks as compared to the nonheat-treated ceramic sealing layer. Such very fine thermal stress cracks are shown in FIG. 3.

While the present invention has been described with reference to specific embodiments thereof, it will be obvious to those skilled in the art that various changes and modifications may be made without departing from the invention in its broader aspects. It is contemplated in the appended claims to cover all such variations and modifications of the invention which come within the true spirit and scope of my invention.

What is claimed as new and desired to be secured by Letters Patent of the United States is:

1. A method of constructing a turbine shroud structure, comprising the steps of:

(a) providing a metal substrate;

(b) providing said metal substrate with mechanical matrix bonding means;

(c) applying a ceramic sealing layer of zirconium oxide with magnesium oxide to said mechanical matrix bonding means; and then (d) heat treating said ceramic sealing layer to increase the rub wear of said ceramic sealing layer and to develop an ordered pattern of very fine cracks therein which reduce the thermal stress in said ceramic sealing layer.

2. A method in accordance with claim 1 in which said ceramic sealing layer comprises zirconium oxide with about 6 to 25 weight percentage magnesium oxide.

3. A method in accordance with claim 2 in which said ceramic sealing layer comprises zirconium oxide with about 20 weight percentage magnesium oxide.

4. A method in accordance with claim 2 in which the heat treatment of step (d) transforms metastable cubic zirconium oxide into monoclinic zirconium oxide.

5. A method in accordance with claim 2 in which the heat treatment of step (d) transforms metastable cubic zirconium oxide into tetragonal zirconium oxide.

6. A method in accordance with claim 2 in which step (c) includes plasma spraying said ceramic sealing layer.

7. A method in accordance with claim 2 in which the heat treatment of step (d) comprises heating said ceramic sealing layer to a temperature of between about 900° to 1400° C.

8. A method in accordance with claim 2 in which said mechanical matrix bonding means provided in step (b) comprises a plurality of pegs extending from said metal substrate.

9. A method in accordance with claim 2 in which step (c) includes applying said ceramic sealing layer to a thickness of less than about 0.090 inches.

* * * * *